United States Patent [19]

Goto

[11] Patent Number: 5,029,420

[45] Date of Patent: Jul. 9, 1991

[54] POLYGON-SHAPED HOUSE

[75] Inventor: Mieko Goto, Shizuoka, Japan

[73] Assignee: Minamifuji Sangyo Kabushiki Kaisha, Japan

[21] Appl. No.: 523,870

[22] Filed: May 15, 1990

[30] Foreign Application Priority Data

Oct. 20, 1989 [JP] Japan ..... 1-271446

[51] Int. Cl.[5] ..... B24B 7/00

[52] U.S. Cl. ..... 52/82; 52/236.1

[58] Field of Search ..... 52/82, 236.1, 79.4

[56] References Cited

U.S. PATENT DOCUMENTS

| | | | |
|---|---|---|---|
| 804,427 | 11/1905 | McNamee | 52/82 |
| 1,533,905 | 4/1925 | Stauffer | 52/82 |
| 2,256,050 | 9/1941 | Hansen | 52/82 X |
| 4,335,558 | 6/1982 | Caldwell | 52/236.1 X |
| 4,760,676 | 8/1988 | Goto | 52/236.1 |

*Primary Examiner*—Richard E. Chilcot, Jr.
*Assistant Examiner*—Wynn Wood
*Attorney, Agent, or Firm*—Finnegan, Henderson, Farabow, Garrett & Dunner

[57] ABSTRACT

A polygon-shaped house is composed of a foundation frame having a symmetrical polygonal shape; columns the lower ends of which are connected to the polygon-shaped foundation frame at vertices of the foundation frame; a beam frame disposed over and in parallel with the foundation frame having a polygonal shape similar to that of the foundation frame, said beam frame being connected at its vertices to the upper ends of the corresponding columns; angle rafters whose lower end portions are connected to the beam frame respectively at the vertices of the beam frame and whose upper ends extend obliquely and upwardly toward a position over the center of the beam frame; and a weighty post member supported by the upper ends of the angle rafters, said upper ends being connected to the post member, and exerting downward force on the angle rafters by its own weight. The polygon-shaped house is simple in framework, permits its easy construction, has sufficiently high strength, and provides a wide free space.

11 Claims, 7 Drawing Sheets

POLYGON-SHAPED HOUSE

BACKGROUND OF THE INVENTION

1) Field of the Invention

This invention relates to a polygon-shaped house of a structure simple in framework and capable of constructing with ease.

2) Description of the Related Art:

In general, conventional houses, particularly, wooden houses are essentially square or rectangular in shapes of their foundation frames and beam frames. Such houses hence require auxiliary beams for reinforcing the beam frames so as to sufficiently bear dead loads inherent in their roofs and so-called snow loads (loads added to the roofs due to snow and the like).

Described specifically, in a conventional typical house, as illustrated in FIGS. 11, 12 and 13, a foundation frame 90 in the form of a square or rectangle is horizontally supported on a foundation not depicted. Four columns 92 in total are provided upright respectively at their corresponding vertices of the foundation frame 90. Moreover, a beam frame 93 in the same shape as that of the foundation frame 90 is connected at its vertices to the upper ends of its corresponding columns 92, so that the beam frame 93 is provided in parallel to the foundation frame 90. In addition, a plurality of auxiliary beams 95 are connectedly provided at a suitable interval so as to bridge between beam elements 93A and 93B parallel to each other, which extend in the longitudinal direction of the beam frame 93, whereby the beam frame 93 is reinforced. Numerals 96, 97 and 98 indicate a purlin, a king post and an angle rafter respectively.

Namely, the roof load P (including dead load and snow load) will exert strong force F on the beam elements 93A and 93B parallel to each other, which extend in the longitudinal direction of the beam frame 93, in their external directions expanding and widening to each other as illustrated in FIGS. 14(A) and 14(B). Therefore, if the auxiliary beams 95 should be nonexistent, it is impossible to provide sufficiently high strength. The beam frame 93 will hence be damaged and/or broken. The provision of the auxiliary beams will however ensure strength capable of sufficiently withstanding the force F.

However, since the provision of plural auxiliary beams in the beam frame is required for such conventional houses, there are problems that their structures become complex, their construction takes much time, and moreover the rise in construction cost is brought about.

In addition, the existence of the auxiliary beams within the beam frame is accompanied by a problem that the entirety of a relatively wide space within the beam frame can not be used as one space.

SUMMARY OF THE INVENTION

The present invention has been made with a foregoing in view and has as its object the provision of a polygon-shaped house simple in framework, easy in construction and sufficiently high in strength.

Another object of this invention is to provide a polygon-shaped house unnecessary to provide any auxiliary beams in a beam frame and hence allowing to utilize a wide space within the beam frame as is.

In an aspect of this invention, there is thus provided a polygon-shaped house comprising:

a foundation frame formed of at least six linear foundation elements and having a symmetrical polygonal shape;

columns the lower ends of which are connected to the polygon-shaped foundation frame so as to stand upright respectively at vertices of the foundation frame;

a beam frame disposed over and in parallel with the foundation frame, formed of linear beam elements and having a polygonal shape similar to that of the foundation frame, said beam frame being connected at its vertices to the upper ends of the corresponding columns;

angle rafters whose lower end portions are connected to the beam frame respectively at the vertices of the beam frame and whose upper ends extend obliquely and upwardly toward a position over the center of the beam frame in such a manner to converge toward a central vertical axis; and a weighty post member supported by the upper ends of the angle rafters, said upper ends being connected to the post member, and exerting downward force on the upper ends of the angle rafters by its own weight.

In addition to the above-described structure, an intermediate beam frame may be constructed at the level between the foundation frame and the beam frame so as to run parallel to the foundation frame and supported by columns so as to have the same polygonal shape as the foundation frame. In this case, a floor face for a second story can be provided along the intermediate beam frame.

The foundation frame and the beam frame and the additional intermediate beam frame preferably have an octagonal shape having vertices at a total of eight points, each of which divides each side of an square into three equal parts.

Owing to the above-described structure, since both foundation frame and beam frame have a symmetrical polygonal shape of at least hexagon and the upper ends of the angle rafters, whose lower end portions are connected to the beam frame at their corresponding vertices, are connected commonly to the weighty post member, the force F exerted on the beam frame due to the load of the roof is symmetrically broken up into at least six directions in total. The force, which is received by each beam element, hence becomes significantly weak. As a result, it is unnecessary to provide any auxiliary beams for reinforcing the beam frame. In addition, it is possible to simplify the structure of a house and hence to facilitate the construction of the house.

In addition, since the auxiliary beams become needless as described above, it is possible to utilize the entirety of a wide space within the beam frame as is.

According to this invention, since the force due to the load of the roof is exerted on the beam elements of the beam frame in a state that the force is symmetrically broken up into a plurality of directions owing to the specific structure, the force, which is received by each of the beam elements, becomes significantly weak. Therefore, it is unnecessary to provide any auxiliary beams in the beam frame. Accordingly, it is possible to simplify the structure of the house and hence to facilitate the construction of the house. As a result, the cost of construction can be reduced. In addition, since sufficiently high strength can be provided as a whole, it is unnecessary to provide any columns in the interior. A wide internal space is hence provided.

Moreover, by connecting the upper ends of the angle rafters, whose lower end portions have been connected to the beam frame, to the weighty post member so as to support the weighty post member, sufficiently high strength can be provided in a structure formed of three members of the weighty post member, angle rafters and beam frame even when a simple connecting means is used. In particular, this effect is surely achieved by controlling the slope of each angle rafter to the horizontal plane to 60 degrees or lower.

Furthermore, by forming both foundation frame and beam frame into an octagonal shape having vertices at a total of eight points, each of which divides each side of an square into three equal parts, it is possible to provide a wider living space relative to the length of a circumference and hence to effectively utilize land. In addition, since the construction elements can be standardized, the cost of construction can be reduced further.

BRIEF DESCRIPTION OF THE DRAWINGS

The above and other objects, features and advantages of the present invention will become apparent from the following description and the appended claims, taken in conjunction with the accompanying drawing, in which:

FIG. 1 is a schematic plan view as to a structure of a foundation frame and columns;

FIG. 2 is a schematic vertical sectional front elevation illustrating a basic framed structure as a whole;

FIG. 3 is an explanatory illustration as to the shape of the foundation frame as viewed in plan;

Figure 8:
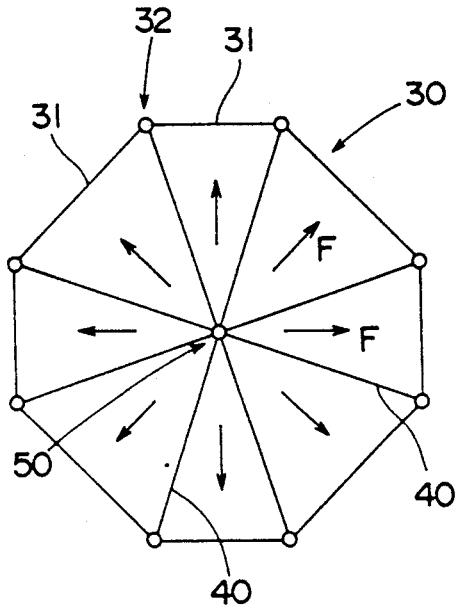
Figure 14A:
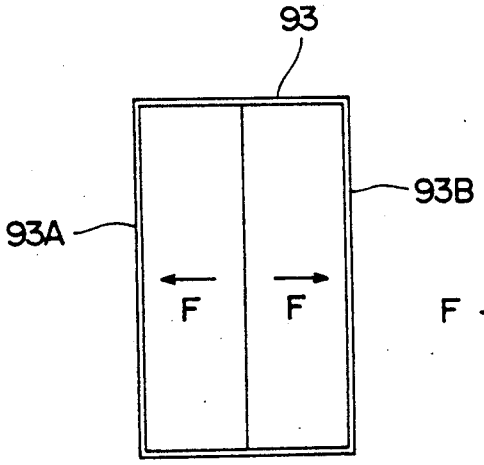
Figure 14B:
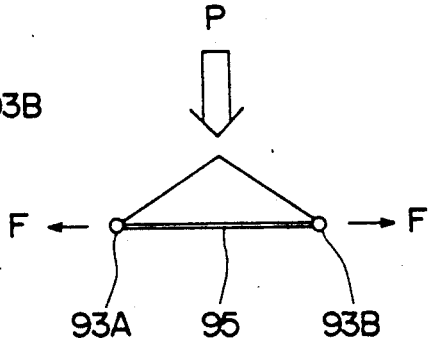
Figure 4:
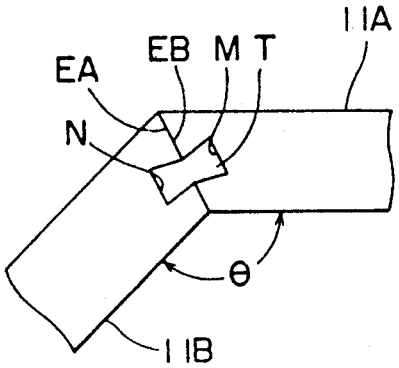
Figure 5:
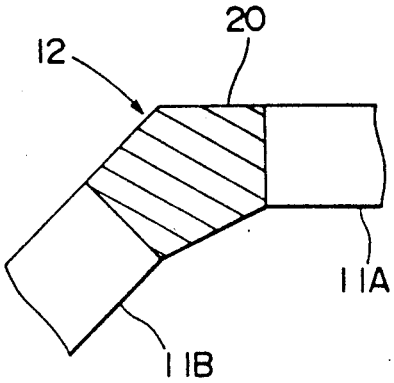
Figure 4:
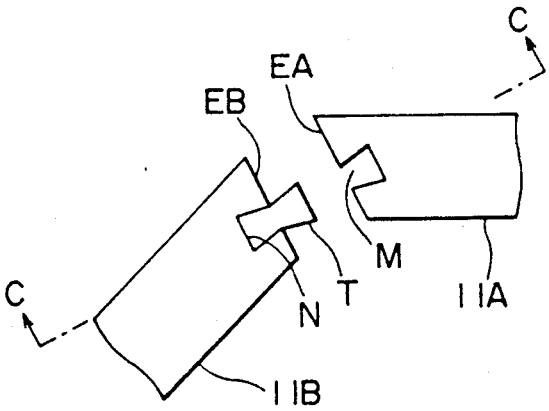
Figure 5:
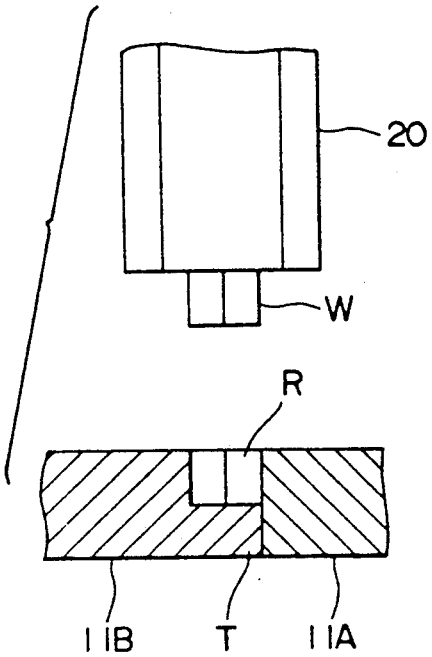
Figure 4:
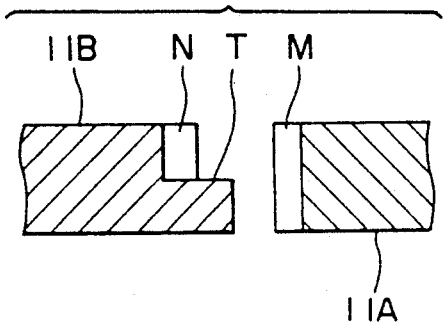
Figure 6:
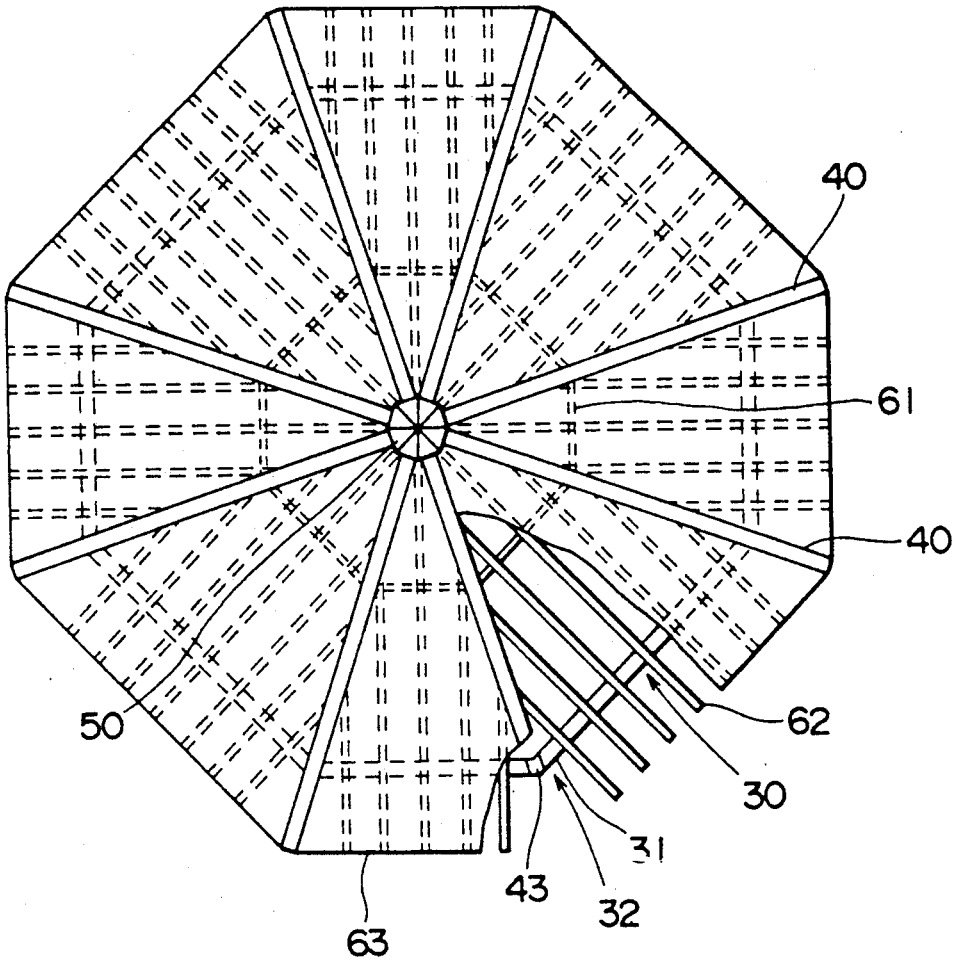
Figure 7:
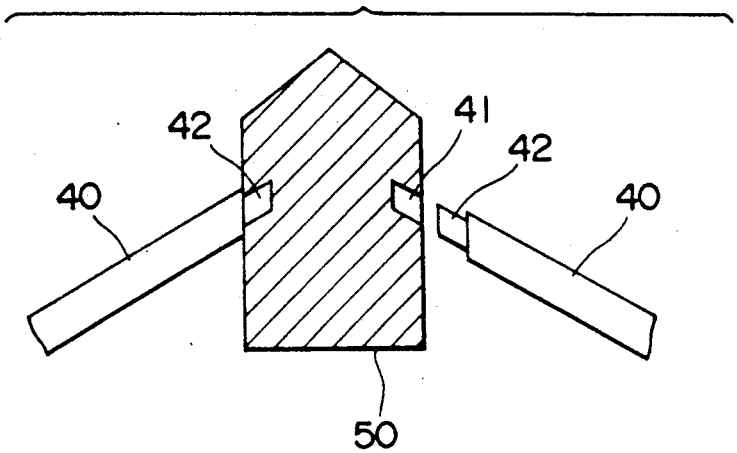
Figure 9:
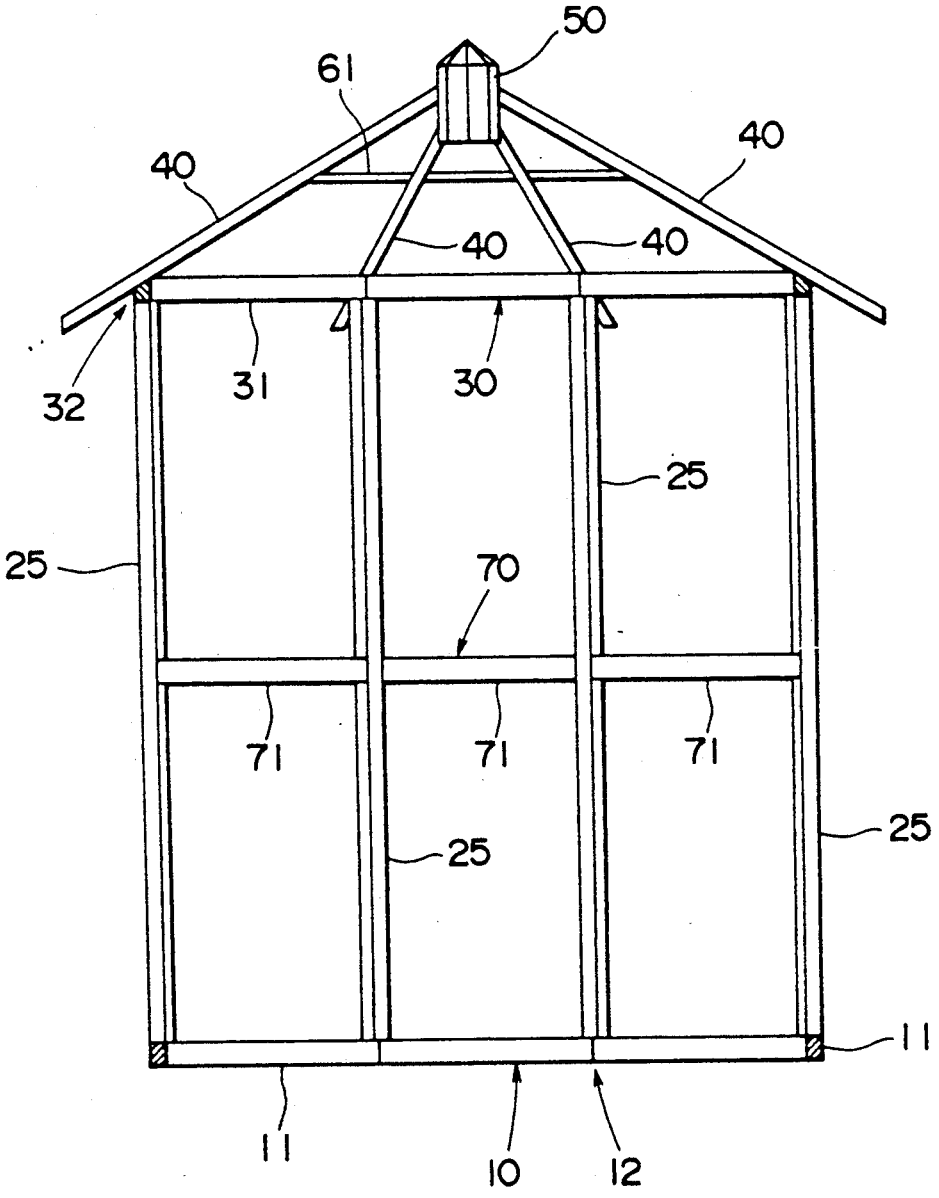
Figure 10:
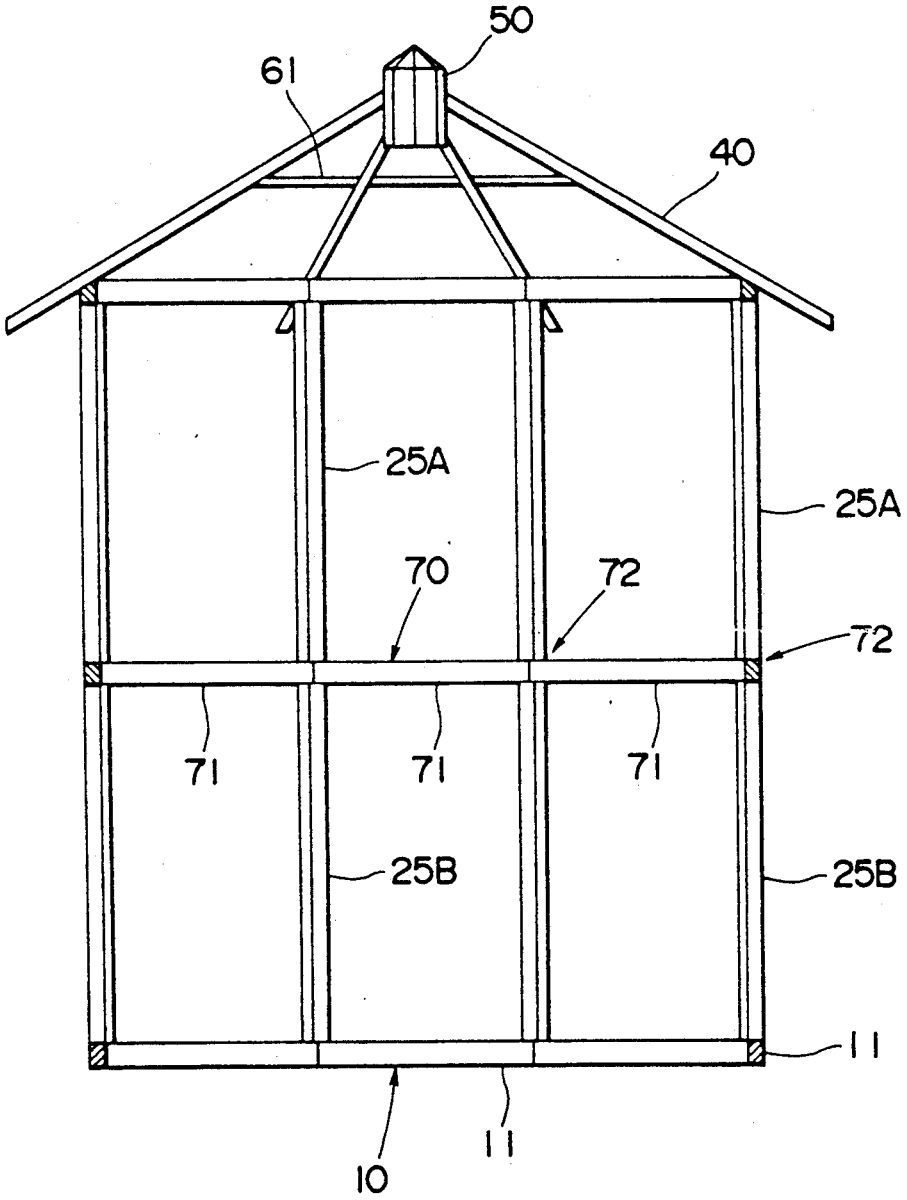
Figure 11:
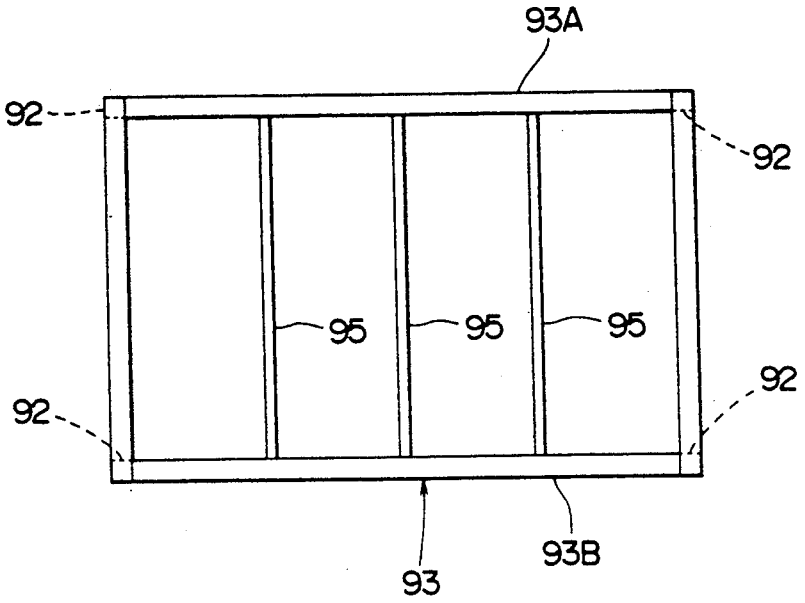
FIG. 11 PRIOR ART
Figure 12:
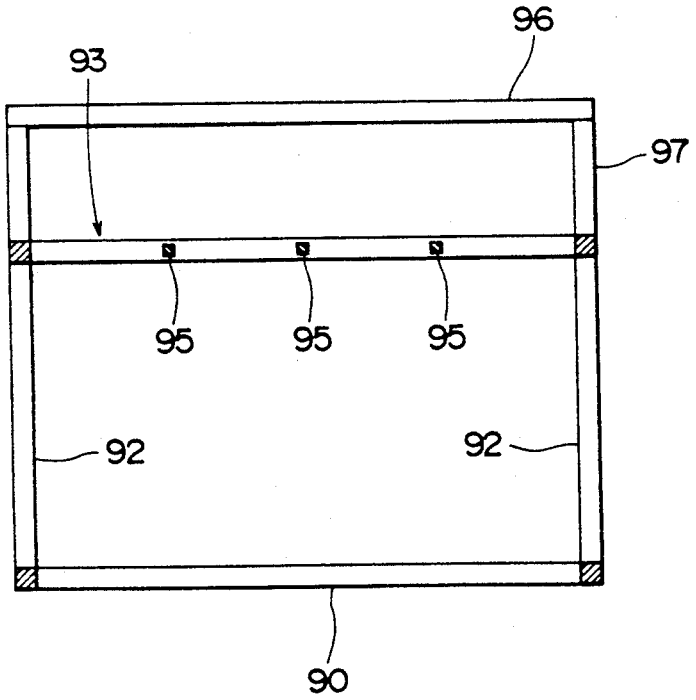
FIG. 12 PRIOR ART
Figure 13:
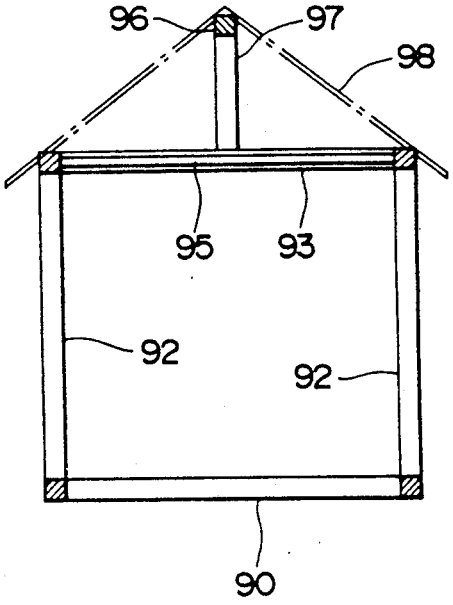
FIG. 13 PRIOR ART

FIGS. (A) through 4(C) are respectively a schematic plan view, a schematic exploded plan view and a schematic cross-sectional view taken on line C—C of FIG. 4(B), all, as to connecting parts in one aspect for connecting foundation elements;

FIGS. 5(A) and 5(B) are respectively a schematic transverse sectional plan view and a view similar to FIG. 4(B), both, illustrating one aspect where a column is connected further to the connecting parts of FIGS. 4(A) through 4(C);

FIG. 6 is a schematic partial cutway plan view of the polygon-shaped house;

FIG. 7 is a schematic cross-sectional view illustrating a connection state of a weighty post member and angle rafters;

FIG. 8 is an explanatory illustration as to force exerted on a beam frame due to the load of a roof in the polygon-shaped house of this invention;

FIG. 9 is a schematic cross-sectional view illustrating a basic framed structure as a whole in a polygon-shaped two-story house according to a second embodiment of this invention;

FIG. 10 is a schematic cross-sectional view illustrating a basic framed structure as a whole in a modification of the second embodiment;

FIG. 11, FIG. 12 and FIG. 13 are respectively a schematic plan view, a schematic vertical sectional front view and a schematic vertical sectional side elevation, all, illustrating a structure of a conventional house; and FIGS. 14(A) and 14(B) are explanatory illustrations as to force exerted on a beam frame due to the load of a roof in the conventional house.

DETAILED DESCRIPTION OF THE INVENTION AND PREFERRED EMBODIMENTS

The embodiments of the present invention will hereinafter be described specifically.

Figure 1:
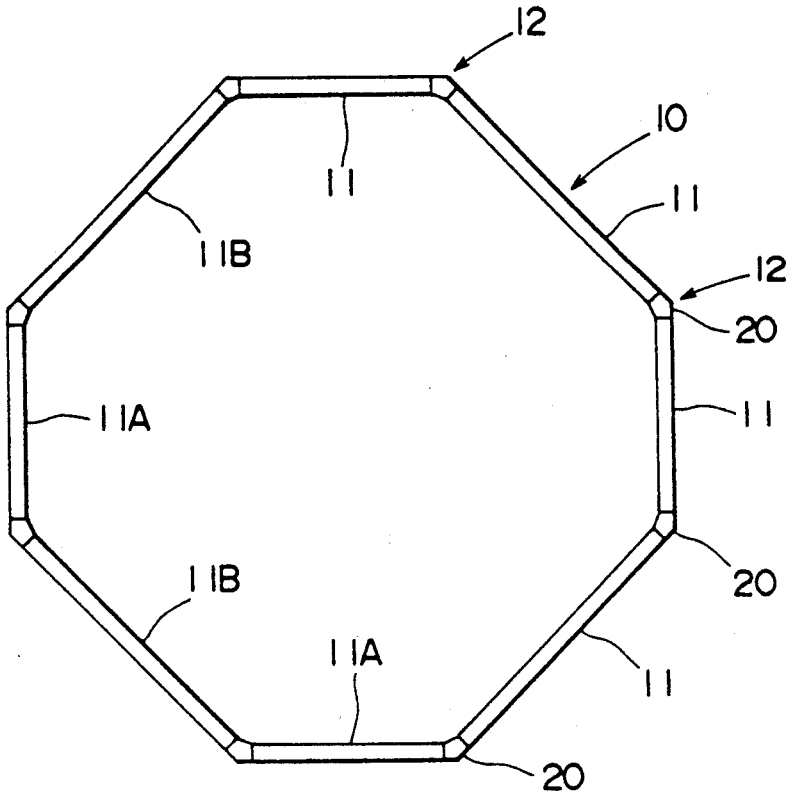
FIG. 1 through FIG. 8 are illustrations with respect to a polygon-shaped house according to a first embodiment of this invention, namely.
Figure 2:
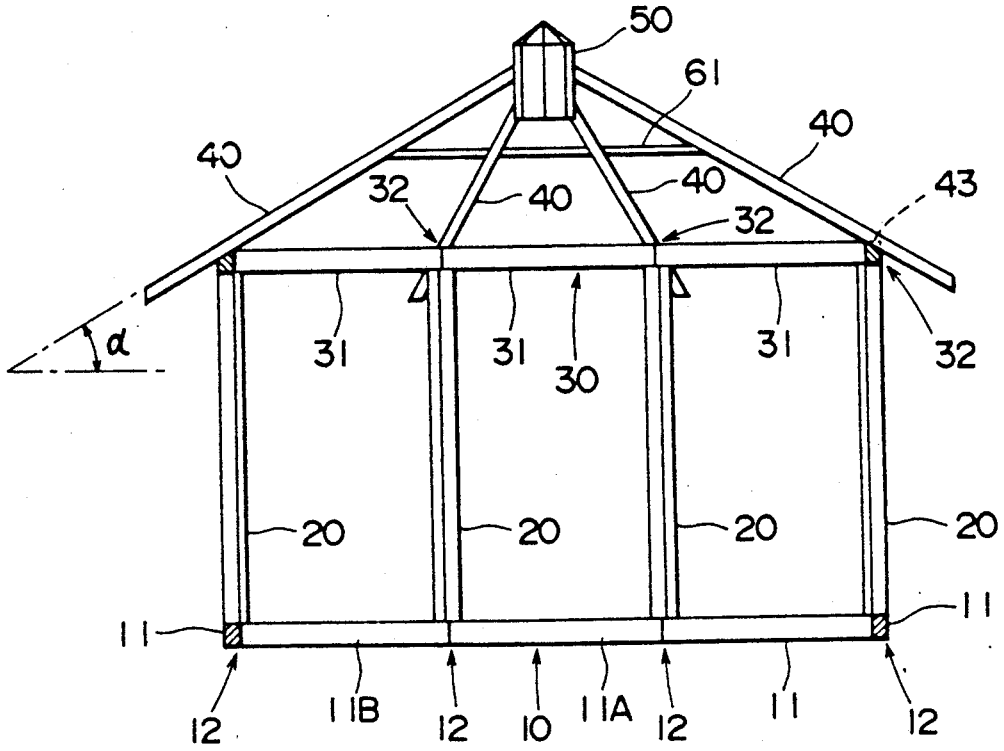

In the first embodiment of this invention, a foundation frame 10 having an octagonal shape as a whole is constructed by a total of eight linear foundation elements 11 made of wood as illustrated in FIG. 1 and FIG. 2. The foundation frame 10 is horizontally supported on a foundation (not illustrated) of a suitable structure. Wooden columns 20 are provided respectively at a total of eight vertices 12 of the foundation frame 10 so as to stand upright.

Figure 3:
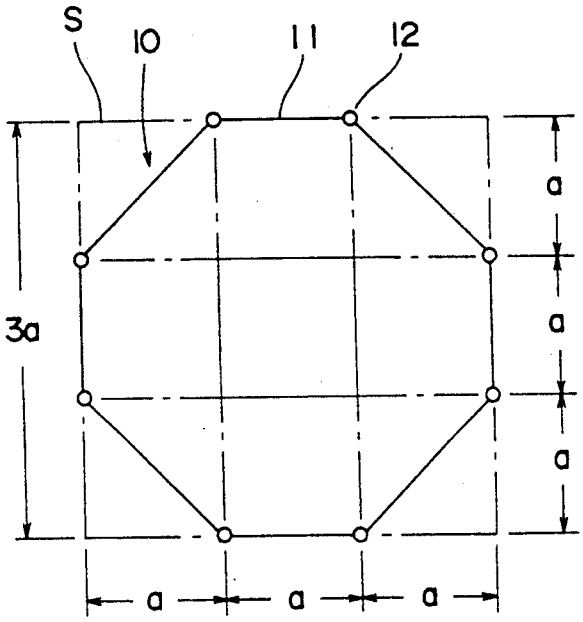

As schematically illustrated in FIG. 3, the shape of the foundation frame 10 in this embodiment is a symmetrical octagonal shape having vertices 12 at a total of eight points, each of which divides each side of a square S into three equal parts, said side having a length of 3a. Therefore, the distance between two adjacent vertices 12 on one side of the square S is a, while the distance between mutually-adjacent vertices 12, which are respectively on two mutually-adjacent sides of the square S, is $\sqrt{2}a$. Accordingly, the foundation frame 10 is constructed by causing four short elements 11A having a length of a and four long elements 11B having a length of $\sqrt{2}a$ to connect alternately and in such a manner that the magnitude of an interior angle at each connected portion is 135 degrees.

The connection of the short element 11A to the long element 11B in the foundation frame 10 is done, for example, in a manner illustrated in FIGS. 4(A) through (C). Namely, the short element 11A and the long element 11B have respectively end faces EA and EB, both, composed of a plane inclined by 45 degrees to their corresponding longitudinal directions. In the end face EA of the short element 11A, a mortise M having a trapezoid shape in sectional contour is formed so as to extend over its full height, and in the end face EB of the long element 11B, a tenon T adapted to fit in the mortise M is projectingly formed on the lower half portion in its heightwise direction and a mortise N similar to the mortise M is formed in the upper half portion in the heightwise direction.

As illustrated in FIG. 4(A), the tenon T is fitted in the lower half portion in the heightwise direction of the mortise M, whereby the short element 11A and the long element 11B are connected to each other in such a state that their end faces EA and EB come into contact with each other and the magnitude of the interior angle $\theta$ at the connected portion is 135 degrees, and a mortise R for connecting a column is defined by the upper half portion of the mortise M in the short element 11A and the mortise N in the long element 11B at the upper half portion in the heightwise direction of the thus-connected portion [see FIG. 5(B)].

In the above description, when the mortise M is formed in the end face EB of the long element 11B and the tenon T and the mortise N are formed at the end face EA of the short element 11A, also, exactly the same connected state as described above can be achieved and the same column-connecting mortise R is defined.

On the other hand, as illustrated in FIG. 5(B), each of the columns 20 has a pentagonal shape in profile, each vertical angle of said pentagon being 135 degrees. In each column 20, a projecting tenon W of a shape adapted to fit in the above-described column-connecting mortise R is formed on its lower end. As illustrated in FIGS. 5(A) and 5(B), the projecting tenon W is fitted in the above column-connecting mortise R, whereby the lower end of the column 20 is connected to the foundation frame 10 at its corresponding vertex 12 of the frame, so that the column 20 is provided upright.

As described above, it is possible to connect suitably three members of two foundation elements 11 and one column 20 at one connecting portion by utilizing a part of the mortise for attaining the mortising of foundation elements at each of connecting portions of the foundation elements 11 in the foundation frame 10 so as to connect the lower end of each column 20 to the foundation frame 10.

On the other hand, as also shown in FIG. 6, a total of eight wooden linear beam elements 31 are connected to one another to construct a beam frame 30 having the same structure as that of the above-described foundation frame 10, namely, the same octagonal shape as that of the foundation frame 10. To the beam frame 30, the upper ends of the above-described eight columns 20 are connected respectively at their corresponding vertices 32, whereby the beam frame 30 is disposed in parallel to the foundation frame 10 and thus, horizontally.

Upon the connection of the beam elements 31 to construct the above beam frame 30, the means for connecting the foundation elements 11 in the foundation frame 10, as described above, or any means similar to this means can be used. In addition, the connection of the beam frame 30 to the upper ends of the column 20 at their corresponding vertices 32 of the beam frame 30 can be conducted by using the above-described means for connecting the foundation frame 10 and the lower ends of the columns 20 or any means similar to this means. It is also possible in this case to connect suitably three members of two beam elements 31 and one column 20 at one connecting portion by utilizing a part of the mortise for attaining the mortising of beam elements at each of connecting portions of the beam elements 31 in the beam frame 30 so as to connect the upper end of each column 20 to the beam frame 30 in the same manner as in the foundation frame 10.

In the drawings, numeral 40 designates angle rafters. Each lower end portion of a total of eight angle rafters 40 is connected to the beam frame 30 at its corresponding vertex 32 of the beam frame 30 of the octagonal shape. In addition, the angle rafters 40 are arranged in a state that their upper ends extend obliquely and upwardly toward a position over the center of the beam frame 30 in such a manner to converge toward a central vertical axis. Moreover, the upper ends are commonly connected to a wooden weighty post member 50 having a relatively heavy weight and an octagonal columnar shape, whereby the weighty post member 50 is made a state supported by the upper ends of the angle rafters 40.

As a means for connecting the upper ends of the angle rafters 40 to the weighty post member 50, it is preferable to use a usual mortising means. Namely, the connection may be conducted in the following manner. As illustrated in FIG. 7, eight angle rafter-connecting mortises 41 in total are formed in the angular periphery of the weighty post member 50 and a projection 42 adapted to be received into the mortise 41 is formed on the upper end of each angle rafter 40, whereby both mortise and projection are fitted to each other to join them.

In order to connect the lower end portion of each of the angle rafters 40 to the beam frame 30, it is only necessary to use a suitable connecting means in a state that the lower end portion is received in its corresponding recess 43 formed at each vertex 32 of the beam frame 30 by way of example.

As needed, a purlin 61 and rafters 62 may be provided connectedly between adjacent angle rafters 40 provided in the above manner. Roof boards 63 made of a water-resistant plywood by way of example is provided thereon.

Although not illustrated, openings between mutually-adjacent columns 20 are closed up by attaching suitable panels, for example, nonbearing panels or bearing panels, between the adjacent columns 20. Window- or exit-/entrance-defining openings are provided in portions of these panels as needed.

The polygon-shaped house constructed in the above-described manner has a structure that the foundation frame 10 and the beam frame 30 are the same in their shape and are symmetrically octagonal, and the upper ends of the angle rafters 40, whose lower end portions are connected to the beam frame 30 respectively at their corresponding vertices 32 of the beam frame 30, are connected commonly to the weighty post member 50. Therefore, although the load of the roof exerts externally expanding and widening force F on the beam frame 30, as illustrated in FIG. 8, this force F is symmetrically broken up into every beam element 31 of the beam frame 30, i.e., eight directions, through the angle rafters 40. As a result, the magnitude of force, which each beam element 31 in the beam frame 30 is to bear, becomes significantly weak compared to the load of the roof. Accordingly, in association with the fact that the beam frame 30 itself is a frame of a polygonal shape, too, sufficiently high strength can be provided by the beam frame 30 alone.

As described above, the provision of auxiliary beams in the beam frame 30 of the polygon-shaped house according to this invention becomes unnecessary. It is therefore possible to simplify significantly the framework as a house structure and at the same time, to facilitate its construction resulting in the reduction in construction cost.

In addition, since the length of unit beam element 31 may be shorter compared with the case where a square or rectangular beam frame having the same width in area is used, higher flexural strength can be provided by the beam elements 31 themselves.

The house according to this invention is provided with sufficiently high strength as a whole because the whole basic framed structure formed of the foundation frame 10, columns 20, beam frame 30, angle rafters 40 and weighty post member 50 is in the form of so-called birdcage. For this reason, it is unnecessary to provide any additional columns in the interior of the structure. In addition, it is also unnecessary to provide any auxiliary beams as described above. Therefore, the space within the structure is a wide free space continuous without mutually dividing it by the level of the beam frame 30 into the upper space and the lower space and free of any structural elements. Accordingly, the interior space of the structure can be utilized at a very high degree of freedom.

Furthermore, since the basic framed structure has sufficiently high strength, the panels provided between columns 20 is not required to exhibit reinforcing effects. It is hence possible to use nonbearing panels as panels useful in the practice of this invention. Needless to say, this does not mean that the use of bearing panels as such panels is forbidden.

Besides, the usual mortising means as described above may be used in order to connect the upper ends of the angle rafters 40 to the weighty post member 50. In this connection as to the angle rafters 40, namely, the connection of the upper ends of the angle rafters 40 to the weighty post member 50 and the connection of the lower end portions of the angle rafters 40 to the beam frame 30, even when their connection is somewhat loose, the looseness at each connected portion of the weighty post member 50, angle rafters 40 and beam frame 30 is absorbed because the weighty post member displaces downward owing to its own weight, whereby a state connected with sufficiently high strength is provided. Therefore, the structure constructed by the weighty post member 50, angle rafters 40 and beam frame 30 is in a state that they are combined with one another with sufficiently high strength. It is hence possible to satisfactorily achieve the connection related to the angle rafters 40 by relatively simple connecting means with ease and certainty at a low cost.

It is preferred that the angle of the slope $\alpha$ (see FIG. 2) of each angle rafter 40 connecting between the weighty post member 50 and the beam frame 30 to the horizontal plane is 60 degrees or lower. This can ensure providing with sufficiently high strength for the structure formed of three members of the weighty post member 50, angle rafters 40 and beam frame 30.

Furthermore, since both foundation frame 10 and beam frame 30 have an octagonal shape having vertices at a total of eight points, each of which divides each side of an square into three equal parts, it is possible to provide a wider living space relative to the length of a circumference and hence to effectively utilize land. In addition, supposing that the length of each side of the square be 3a, it is only necessary to provide each two types of standardized members, one having a length or width of a and the other one a length or width of $\sqrt{2}a$, as members for the foundation elements, beam elements and panels provided between the columns 20. Industrial mass production of these members is hence allowed. The cost of construction can also be reduced further from this point.

FIG. 9 illustrates a second embodiment of this invention. This embodiment is a case where a two-story polygon-shaped house is constructed.

In the second embodiment, the whole structure is basically the same as in the first embodiment described above. It is however different in that columns 25 sufficiently long in height are used instead of the columns 20 and an intermediate beam frame 70 is provided at a center level of the columns 25.

The intermediate beam frame 70 serves to provide a floor face for a second story along it, thereby permitting the provision of a two-story polygon-shaped house as a whole.

Described specifically, sufficiently-long wooden columns 25 are connected to a foundation frame 10 respectively at their corresponding vertices 12 of the frame so as to stand upright. To the upper ends of the columns 25, a beam frame 30 is connected respectively at their corresponding vertices 32. At the vertices 32 of the beam frame 30, the lower end portions of eight angle rafters 40 are respectively connected thereto, while the upper ends of the angle rafters 40 are connected to a weighty post member 50.

At the center level of the columns 25, as described above, a total of eight linear intermediate beam elements 71 made of wood are horizontally connected to one another so as to bridge between mutually-adjacent columns 25, so that an intermediate beam frame 70 having the same octagonal shape as both foundation frame 10 and beam frame 30 and connected to the columns 25 respectively at their corresponding vertices 72 is constructed at a level at which the distance between the foundation frame 10 and the beam frame 30 is divided into two equal lengths in a state parallel thereto.

In the above description, mortising by way of example may preferably be used in order to connect the intermediate beam elements 71 to the column 25.

In the second embodiment, excellent effects are also exhibited like the first embodiment. There is thus provided a two-story polygon-shaped house which is simple in structure, is easy in construction and permits reducing the cost of construction.

FIG. 10 illustrates further a modification of the second embodiment. Compared to the second embodiment, this embodiment is different in that each of long columns 25 is divided into two pieces of an upper part 25A and an lower part 25B, an intermediate beam frame 70 having the same octagonal shape as that of the foundation frame 10 or the beam frame 30 is constructed by connecting eight linear intermediate beam elements made of wood in the same manner as in the construction of the foundation frame 10 or the beam frame 30, and the intermediate beam frame 70 is connected at its vertices 72 between the upper parts 25A and the lower parts 25B of their corresponding columns 25.

In the above description, it is possible to use the same connecting means as employed in the construction of the foundation frame 10, which has been described above, in order to interconnect the intermediate beam elements 71. Besides, any means similar to that illustrated in FIG. 5 or other suitable means may be used in order to connect the intermediate beam frame 70 to the upper part 25A and the lower part 25B of each column 25.

In this modification, excellent effects similar to those described above are also exhibited. There is thus provided a two-story polygon-shaped house which is simple in structure, is easy in construction and permits reducing the cost of construction.

Having now fully described the invention, it will be apparent to one of ordinary skill in the art that many changes and modifications can be made thereto without departing from the spirit or scope of the invention as set forth herein.

What is claimed is:

1. A polygon-shaped house comprising:

a foundation frame formed of at least six linear foundation elements and having a symmetrical polygonal shape;

columns the lower ends of which are connected to the polygon-shaped foundation frame so as to stand upright respectively at vertices of the foundation frame;

a beam frame disposed over and in parallel with the foundation frame, formed of linear beam elements and having a polygonal shape similar to that of the foundation frame, said beam frame being connected at its vertices to the upper ends of the corresponding columns;

angle rafters having lower end portions connected to the beam frame respectively at the vertices of the beam frame and upper ends extending obliquely and upwardly toward a position over the center of the beam frame in such a manner to converge toward a central vertical axis; and a weighty post member supported by the upper ends of the angle rafters, sand upper ends being connected to the post member, and exerting downward force on the upper ends of the angle rafters by its own weight, each upper end of the angle rafters being mortised into the periphery of the weighty post member.

2. The polygon-shaped house as claimed in claim 1, wherein an intermediate beam frame is provided at a level between the foundation frame and the beam frame in parallel to the foundation frame, said intermediate beam frame having the same polygonal shape as that of the foundation frame and being supported by columns, and a floor face for a second story is provided along the intermediate beam frame.

3. The polygon-shaped house as claimed in claim 1 or 2, wherein the foundation frame and the beam frame have a symmetrical octagonal shape.

4. The polygon-shaped house as claimed in claim 3, wherein the foundation frame and the beam frame have an octagonal shape having vertices at a total of eight points, each of which divides each side of a square into three equal parts.

5. The polygon-shaped house as claimed in claim 1 or 2, wherein a rising slope of each angle rafter to the horizontal plane is 60 degrees or lower.

6. The polygon-shaped house as claimed in claim 1 or 2, wherein spaces between adjacent columns are closed up by nonbearing panels.

7. The polygon-shaped house as claimed in claim 2, wherein the intermediate beam frame is constructed by a plurality of linear intermediate beam elements connected to mutually-adjacent columns so as to bridge therebetween.

8. A polygon-shaped house comprising:

a foundation frame formed of at least six linear foundation elements and having a symmetrical polygonal shape;

columns the lower ends of which are connected to the polygon-shaped foundation frame so as to stand upright respectively at vertices of the foundation frame;

a beam frame disposed over and in parallel with the foundation frame, formed of linear beam elements and having a polygonal shape similar to that of the foundation frame, said beam frame being connected at its vertices to the upper ends of the corresponding columns;

angle rafters having lower end portions connected to the beam frame respectively at the vertices of the beam frame and upper ends extending obliquely and upwardly toward a position over the center of the beam frame in such a manner to converge toward a central vertical axis; and a weighty post member supported by the upper ends of the angle rafters, sand upper ends being connected to the post member, and exerting downward force on the upper ends of the angle rafters by its own weight;

said foundation frame being constructed by mortising each of linear foundation elements into two foundation elements adjacent thereto and each lower end of the columns being mortised by making use of a part of the mortise adapted to achieve mortising of the foundation elements at its corresponding vertex of the foundation frame.

9. A polygon-shaped house comprising:

a foundation frame formed of at least six linear foundation elements and having a symmetrical polygonal shape;

columns the lower ends of which are connected to the polygon-shaped foundation frame so as to stand upright respectively at vertices of the foundation frame;

a beam frame disposed over and in parallel with the foundation frame, formed of linear beam elements and having a polygonal shape similar to that of the foundation frame, said beam frame being connected at its vertices to the upper ends of the corresponding columns;

angle rafters having lower end portions connected to the beam frame respectively at the vertices of the beam frame and upper ends extending obliquely and upwardly toward a position over the center of the beam frame in such a manner to converge toward a central vertical axis; and a weighty post member supported by the upper ends of the angle rafters, sand upper ends being connected to the post member, and exerting downward force on the upper ends of the angle rafters by its own weight;

said beam frame being constructed by mortising each of linear beam elements into two elements adjacent thereto and each upper end of the columns being mortised by making use of a part of the mortise adapted to achieve mortising of the beam elements at its corresponding vertex of the beam frame.

10. The polygon-shaped house as claimed in either of claims 8 or 9, wherein an intermediate beam frame is provided at a level between the foundation frame and the beam frame in parallel to the foundation frame, said intermediate beam frame having the same polygonal shape as that of the foundation frame and being supported by columns, and a floor face for a second story is provided along the intermediate beam frame.

11. A polygon-shaped house comprising:

a foundation frame formed of at least six linear foundation elements and having a symmetrical polygonal shape;

columns the lower ends of which are connected to the polygon-shaped foundation frame so as to stand upright respectively at vertices of the foundation frame;

a beam frame disposed over and in parallel with the foundation frame, formed of linear beam elements and having a polygonal shape similar to that of the foundation frame, said beam frame being connected at its vertices to the upper ends of the corresponding columns;

angle rafters having lower end portions connected to the beam frame respectively at the vertices of the beam frame and upper ends extending obliquely and upwardly toward a position over the center of the beam frame in such a manner to converge toward a central vertical axis;

a weighty post member supported by the upper ends of the angle rafters, sand upper ends being connected to the post member, and exerting downward force on the upper ends of the angle rafters by its own weight; and an intermediate beam frame provided at a level between the foundation frame and the beam frame in parallel to the foundation frame, said intermediate beam frame having the same polygonal shape as that of the foundation frame and being supported by columns, and a floor face for a second story being provided along the intermediate beam frame; each of the columns being divided into two pieces of an upper part and a lower part, the intermediate beam frame being constructed by connecting each of plural linear intermediate beam elements to two intermediate beam elements adjacent thereto, and the intermediate beam frame being connected at its vertices between the upper parts and the lower parts of their corresponding columns.

* * * * *

UNITED STATES PATENT AND TRADEMARK OFFICE

CERTIFICATE OF CORRECTION

PATENT NO. : 5,029,420

DATED : July 9, 1991

INVENTOR(S) : MIEKO GOTO

It is certified that error appears in the above-identified patent and that said Letters Patent is hereby corrected as shown below:

Claim 1, column 9, line 6, change "sand" to --said--.

Claim 8, column 9, line 60, change "sand" to --said--.

Claim 9, column 10, line 24, change "sand" to --said--.

Claim 11, column 10, line 63, change "sand" to --said--.

Signed and Sealed this

Twenty-third Day of March, 1993

*Attest:*

STEPHEN G. KUNIN

*Attesting Officer*

*Acting Commissioner of Patents and Trademarks*